US009901223B2

(12) United States Patent
Ricketts

(10) Patent No.: US 9,901,223 B2
(45) Date of Patent: Feb. 27, 2018

(54) MYTIME

(71) Applicant: Rhea Veronica Ricketts, Brampton (CA)

(72) Inventor: Rhea Veronica Ricketts, Brampton (CA)

(73) Assignee: Rhea Ricketts, Brampton, Ont. (CA)

( * ) Notice: Subject to any disclaimer, the term of this patent is extended or adjusted under 35 U.S.C. 154(b) by 0 days.

(21) Appl. No.: 14/816,839

(22) Filed: Aug. 3, 2015

(65) Prior Publication Data

US 2017/0035258 A1 Feb. 9, 2017

(51) Int. Cl.

*A47K 10/48* (2006.01)
*A47K 3/28* (2006.01)
*A47K 3/36* (2006.01)

(52) U.S. Cl.

CPC ..... *A47K 10/48* (2013.01); *A47K 3/282* (2013.01); *A47K 3/283* (2013.01); *A47K 3/36* (2013.01)

(58) Field of Classification Search

CPC ... F26B 3/00; F26B 5/00; A47K 10/48; A47K 3/282; A47K 3/283; A47K 3/36
USPC ..... 34/90, 104, 105; 4/597, 601
See application file for complete search history.

(56) References Cited

U.S. PATENT DOCUMENTS 3,587,118 A * 6/1971 Compton ..... A47K 3/022 4/597
4,733,421 A * 3/1988 Kuersteiner ..... A47K 7/04 15/88.3
4,871,900 A * 10/1989 Hickman ..... F26B 9/006 34/202
5,099,587 A * 3/1992 Jarosch ..... A47K 10/48 34/202
5,752,326 A * 5/1998 Trim ..... A47K 10/48 34/219
5,930,912 A * 8/1999 Carder ..... A47K 10/48 34/202
6,067,725 A * 5/2000 Moser ..... A47K 10/48 34/223

(Continued)

FOREIGN PATENT DOCUMENTS

DE 19824690 A1 * 12/1999 ..... A45D 20/16
EP 1719490 A2 * 11/2006 ..... A61H 33/06

(Continued)

*Primary Examiner* — Stephen M Gravini

(57) ABSTRACT

A two parts shower/hair and body care dryer system that is contained within one installation unit. The shower and drying units are enclosed with durable glass wall and separated with bi-fold glass shower doors between the shower and the drying room. These doors are fold on the wall after showering by the user to access the drying room and to exist the unit. It is uniquely designed for everyone including the physically challenged. Imagine, after showering, having the pleasure of heated flooring in a drying room and a quiet flow of warm air from a built in over head dryer that blows radiating heat, covering ones body from head to toe. The dryer has many air vents that make the drying experience quicker, comforting and relaxing as the user is blown dry, which is un-achievable with the use of towels. The over head dryer also has a detachable hand held dryer for added convenience. The bi-fold glass shower doors decrease the size of the shower room when in use, and increase its size when the dryer is being used.

4 Claims, 5 Drawing Sheets

(56) References Cited

U.S. PATENT DOCUMENTS

| | | | | | |
|---|---|---|---|---|---|
| 6,148,539 | A * | 11/2000 | Hatfield | A47K 10/48 | 34/223 |
| 6,681,417 | B2 * | 1/2004 | Brunelle | A61H 33/06 | 4/524 |
| 6,962,005 | B1 * | 11/2005 | Khosropour | A47K 10/48 | 34/218 |
| 7,503,926 | B2 * | 3/2009 | Daffer | A61H 9/00 | 607/81 |
| 8,438,753 | B2 * | 5/2013 | Martin | A47K 3/281 | 236/94 |
| 8,713,814 | B2 * | 5/2014 | Martin | A47K 3/281 | 236/19 |
| 2015/0052675 | A1 * | 2/2015 | Desmelyk | A47K 3/28 | 4/597 |

FOREIGN PATENT DOCUMENTS

| | | | | | |
|---|---|---|---|---|---|
| GB | 2020970 | A * | 11/1979 | | A47K 10/48 |
| GB | 2266662 | A * | 11/1993 | | A47K 3/281 |
| GB | 2413955 | A * | 11/2005 | | A47K 3/30 |
| KR | 20100132365 | A * | 12/2010 | | |
| WO | WO 2008156467 | A1 * | 12/2008 | | A61H 33/06 |

* cited by examiner

MYTIME

FIELD

Background of Invention

This invention is a shower room that is built with a drying room and many features for comfort and relaxation. In regard to prior arts, there have been showers and dryers that are patented by United States Patent and Trademark Office, but none is exactly similar to the My Time shower/hair and body care Drying system. On Nov. 8, 2005, inventors: Michael Khosropour, Harold Leung, Jim R. Pauls and Bob A. Davis, received U.S. Pat. No. 6,962,005, B1. From the publication we learned that their invention is a shower dryer system that has a dryer tower with nozzles for directing heated air into a shower enclosure interior.

Another is Patent No: US 2005/0086735 A1, issued on Apr. 28, 2005 to inventor DaeSong Lim. Lim's invention is a shower recess assembly incorporating body dryer. Third is Patent: US 2013/0133134 A1, that is published May 30, 2013, and invented by Hussain S. A. Faridoon. This invention is a therapeutic shower and method of using the shower for weight reduction.

The concept of this invention is to build a Shower/Hair and Body Care Drying System within one installation, that is structured to give females, males and the physically challenged, the convenience of having their personal needs done in an environment that is elegant and relaxing.

SUMMARY

In an embodiment, two parts shower/hair and body care drying System that is contained within one installation unit; a shower and drying unit Separated with bifolding shower doors that is uniquely designed for everyone, including physically challenged individuals. This two parts shower hair and body care drying System provides the convenience of having personal needs done in an environment that is elegant, comforting and relaxing to help reduce Stress, which is un-achievable with the use of towels. The Said two parts shower/hair and body care drying System comprises: A built in over head dryer that gives a quiet flow of Soothing warm air, after showering. The Said dryer as an attached hand held dryer, that is easily remove with a light pull and Snaps back into place after using, for added convenience. The Said dryer is; insulated and as a built in Swivel/adjustable vented head that is trimmed with multi-colored led lights, and a control switch for preference of color and temperature. The user is blown dry quickly, or slowly for relaxation, which is enhanced with the warmth of the heated flooring.

In an embodiment, the said two parts shower/hair and body care drying system as in claim one comprises: Three doors and two entrances; the front door With the handle, the bi-fold doors between the shower and the drying room and the bi-folds door in the drying room that allows the user to exist the unit. The entrances are from the front door and at the exist door of the drying room. The said units comprises: Switches for both units on both sides on the perimeters, giving users the choice of Switching all or any of the lights on from any of the two entrances before entering and existing the units.

In an embodiment, the said shower room appears enlarge when the doors between the shower and drying room is folded on the wall by the user, to gain entrance to the drying. The drying room, also, seem further enlarge when the user folds the door on the Wall of the drying room, after using the Over head dryer to exists the unit, and the entire area is now open, and is looking as one unit.

In an embodiment, the Said two parts shower/hair and body drying System as in claims one and two further comprises: A Water-proof chair with an extended foot rest, that glides in and out, and the options for a built in Cubby-hole in the front of the foot-rest for toiletries.

In an embodiment, said chair as in claim three further comprises: The extended foot rest stored under the Seat and a user has the choice of; Sitting or Standing while being blown dried quickly without the use of towels, or decrease the heat and be dries slowly for Self care and relaxation. The Said chair can be positioned to Suit the users needs.

In an embodiment, that a user also has the option of being blown dried: with the Water-proof chair removed and the bi-fold doors in the shower and drying room, folded on the wall, as in claim two, will not only have shown an enlarged area but will disclose that the Shower/Hair and Body Care Drying System is contained within one installation unit.

Advantages and Customize Orders

In an embodiment, MY Time Shower/Hair and Body Care System as many advantages: The built in over head dryer can be advertised as a feature for new homes, condos, and hotels. It, also, can be installed in aquatic recreational areas, and health care facilities.

In an embodiment, The built in over the head dryer can also be installed in existing homes with a bathtub or a shower room.

In an embodiment, water-proof chair with the foot rest that glides in and out, can be retailed with or without the cubby-hole built in it. Cost for Customized Orders is predetermined Such as: Remote control for the water-proof chair, and building a cubby-hole within the front of the extended foot rest for storage, a vase or other decorative objects that appeal to the user, hidden built in wall shelf behind the head to toe mirror, or a open wall shelf (shelves not shown), change in head to toe mirror and trims, a monitor or television, (television not shown) for added relaxation while being blown dry.

DETAILED DESCRIPTION

The shower room is equipped with a rain-fall shower head, that gives an enormous flowing stream of warm water. It is also trimmed with multi-colored led lights that trickle from the vents when the water is flowing, and the user can change the color of the lights as desire. There is a built in soap container and drainage.

The drying room as a built in over head dryer that is also trimmed with multi-colored led lights and it also has control switches. The dryer is insulated and gives a quiet flow of warm air. The dryer swivels, to accommodate the drying experience. The dryer as an attached hand held dryer, that is easily removed and replaced, and the drying room as heated flooring. There is also: a chandelier, a full body mirror, a monitor with drawings of small fishes, and a water-proof chair for with extended foot rest for skin such as skin care and cosmetics as desire. There are three doors and two entrances: The front door with the handle, the door between the shower room, and the exist door of the drying room. The two entrances are; the front door with the handle, and the exist door.

On both sides of the perimeters are the switches for the lights and the heated floor, which can be access from the two entrances. For e.g., on the right side of the perimeter is the decorated vase and the switches for the light and the heated floor in the drying room, and on the left side of the perimeter, are switches for the light in the shower room and the heated floor as well as a switch for the monitor.

Usage: While showering, the size of each unit remain the same. After showering, the user folds the bi-fold doors on the wall between the shower and the drying room to access the dryer, and is welcome with the warmth of the floor in the drying room. The user then, turn the control switch on and have the option of being blown dried quickly, without the use of towels or decrease the heat and achieve more time for; self care and relaxation while enjoying the elegance of the led light trims around the over head dryer and the chandelier.

Folding the bi-fold door on the wall enlarges the shower room, as the user is being blown dried. The user can sit on the water-proof chair while being blown dry and the chair can be positioned as desired. There is also an option to have a cubby-hole built in the front of the extended foot-rest for storing toiletries. There is a full body bevelled mirror, with trims around the edges to give users the opportunity to view, admire and give a bit more attention to the beauty of their bodies, while doing their skin care, applying cosmetics and enjoying the radiant warm heat from the over head dryer.

After using the dryer, the user folds the bi-fold shower door on the wall and exist the units. Folding the bi-fold doors on the wall in the dryer room as well as the shower room, open the entire units. When the water-proof chair is not being used, the area further expands and presents a single unit within one installation.

Figure 1:
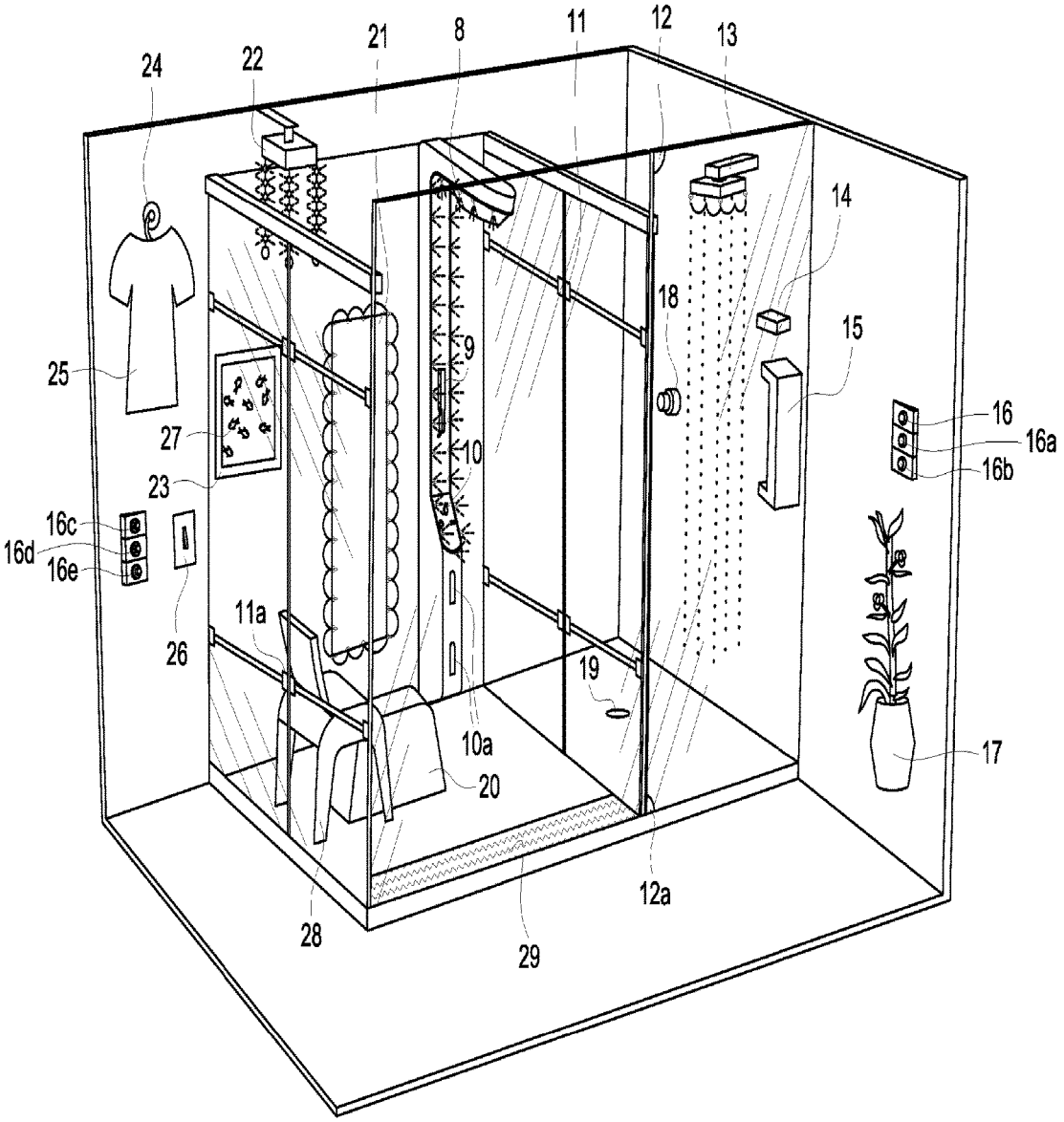
FIG. 1 is a perspective view of the system, according to an embodiment described herein.

Referring now to the figures, FIG. 1 illustrates the shower/hair and body care system with all its features that coordinates with the preferred embodiment of the invention.

Figure 2:
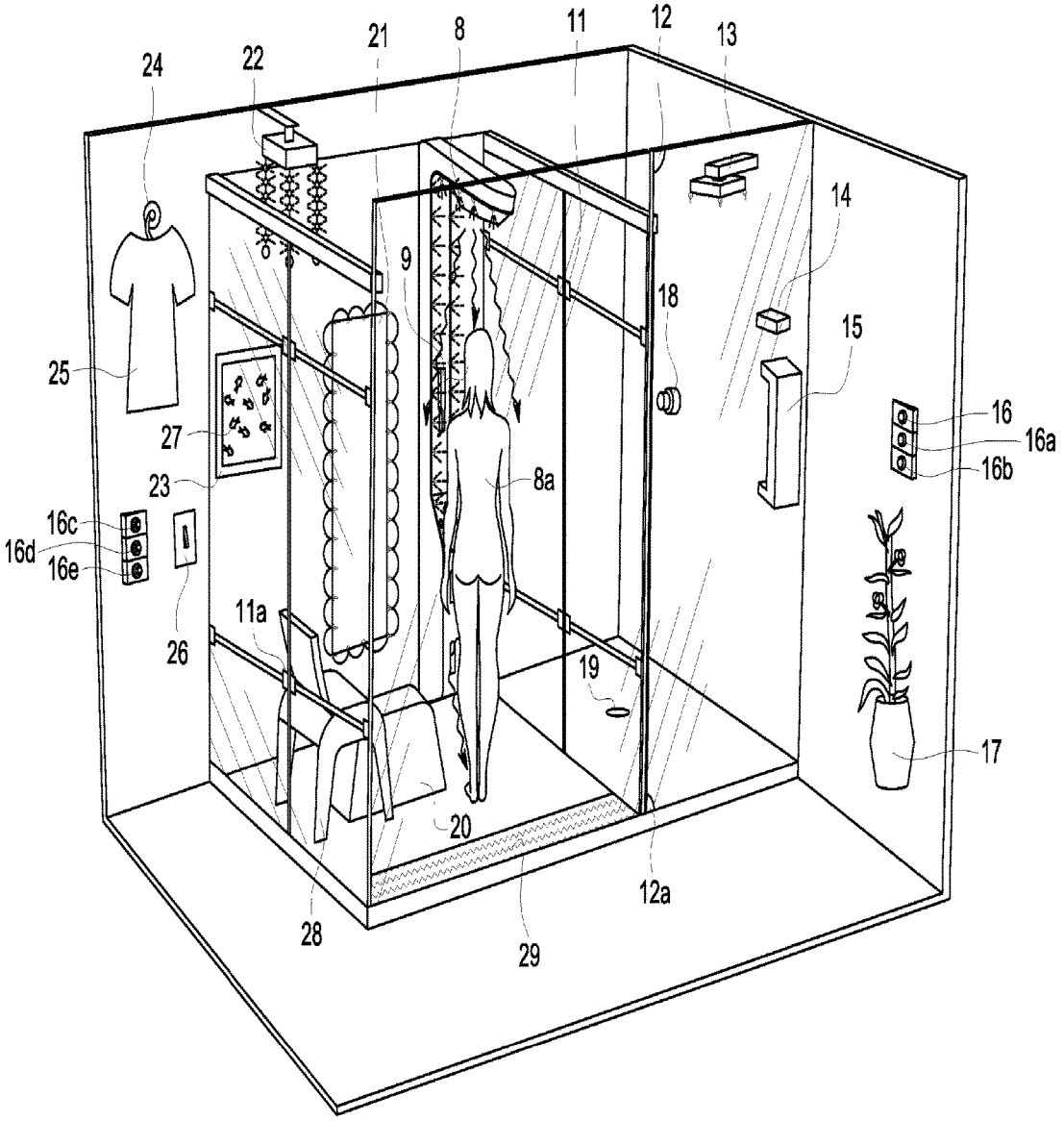
FIG. 2 is a perspective view of the system, according to an embodiment described herein.

FIG. 2. is showing the dryer being used and the same features as in FIG. 1.

Figure 3:
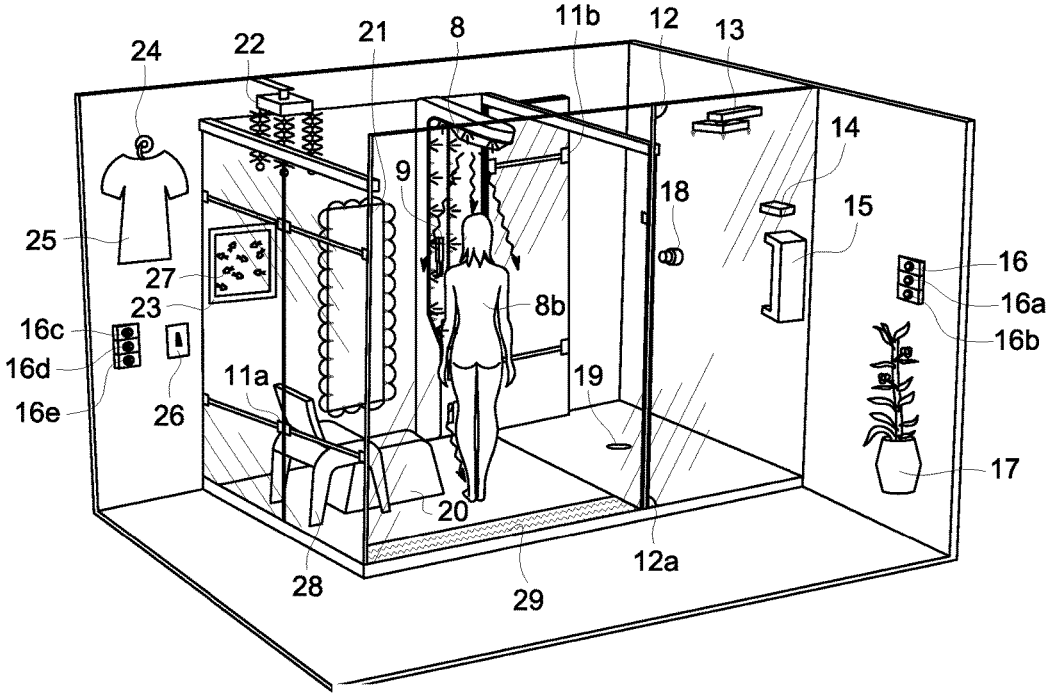
FIG. 3 is a perspective view of the system, according to an embodiment described herein.

FIG. 3. The dryer being used, the doors that divide the shower and the drying room are folded on the wall, the shower room is now open and the area expand. Other features are same as in FIGS. 1 and 2.

The dryer is now being used, the gown is no longer hanging on the hook, the bi-fold doors in drying room as well as the shower room are now folded on the wall, both units are now open and appears enlarged. Other features remain same as in FIGS. 1, 2, and 3.

Figure 4:
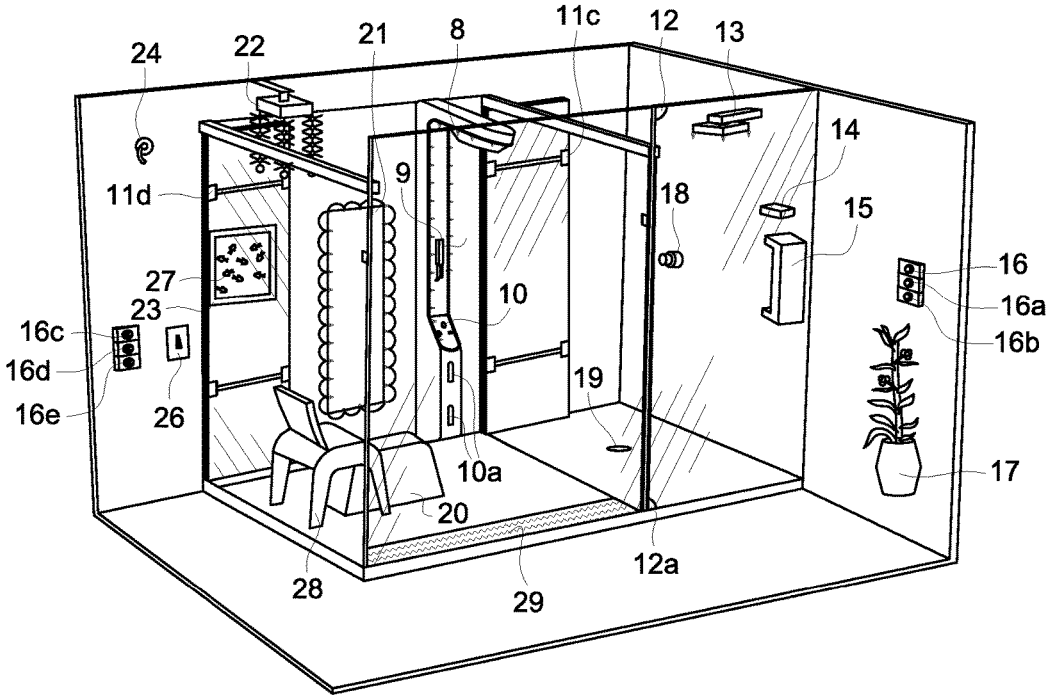
FIG. 4 is a perspective view of the system, according to an embodiment described herein.
Figure 5:
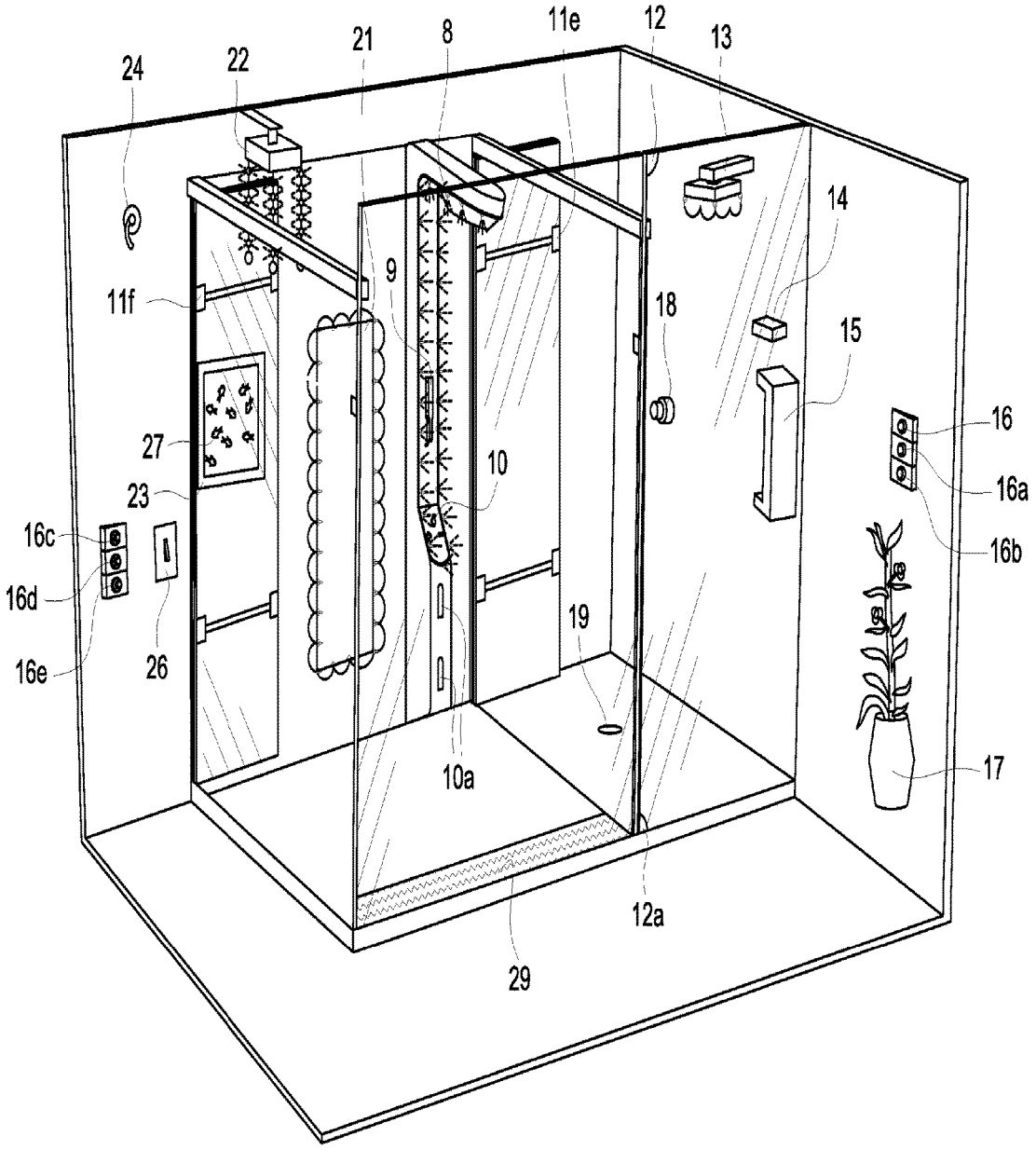
FIG. 5 is a perspective view of the system, according to an embodiment described herein.
Figure 6:
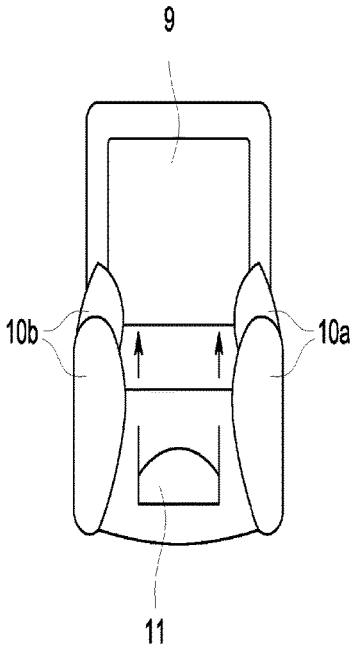
FIG. 6 is a front elevational view of the system, according to an embodiment described herein.

FIG. 4. The shower and drying units appears further enlarged, when the doors that divide both units are on the wall, and the water-proof chair is not being used, in the drying room. Other features remain same.

In an embodiment, the back of the water-proof chairs, 10*a* and 10*b* are the arms of the chairs, and 11, is the extended foot-rest.

In an embodiment, 11*a*, is cover for the cubby-hole. In an embodiment, 11*b*, is the exposed lock covering for the cubby-hole in the water-proof chair with the extended foot-rest.

In an embodiment, the built in over the head dryer with multi-colored led light trims (pointed areas), and at 9 is the hand held dryer that is easily attached and replaced. At 10 are the control switches, and at 10*a* are the vents on the dryer for the user lower body. 11 and 11*a* are the hinges on the bi-fold shower doors, 12 and 12*a* are hinges for the entrance door, with the handle. At 13 is the rain-fall shower head with the multi-colored led light trim (coloured light trims not shown), 14 is the built in soap container, 15 is the handle of the entrance door.

In an embodiment, the electrical switches are on the right and left side of the perimeter of the units. At 16, is the switch for the multi-colored led light that trims the rain-fall shower head in the shower room, 16*a*, is the switch for the chandelier in the dryer room, at 16*b*, is the switch for the heated floor in the dryer room. At 16*c*, is the switch for the chandelier in the drying room, 16*d* is the switch for the multi-colored led light around the rain-fall shower-head in the shower room and 16*e* is the switch for the heated flooring in the drying room.

In an embodiment, a user, therefore, has access to the lights and also choice of lights, and the heated flooring from the front door entrance and also from entering through the exit door of the drying room.

In an embodiment, the decorated vase, 18 is the knob for the rain-fall shower head, 19 is the drainage in the shower room, 20 is the extended foot rest, 21 is the head to toe mirror with the trimmed edge, 22 is the chandelier, 23 is the monitor, 27 is the drawings of tiny fishes on the monitor, 24 is the hook on the wall, 25 is the gown on the hook, 26 is the switch for the monitor, 28 is the chair, and 29 is heated flooring in the drying room.

In an embodiment, 8*a*, is showing the dryer being used and the heat from the over head dryer radiating on the user from her head to her toe. (Other features are same as in FIG. 1) In an embodiment, the user being blown dried, and 11*b*, is showing that the bi-fold doors are now folded on the wall between the shower and the drying room, which opens the shower room and as made the shower room appears larger. (Other features remain same).

In an embodiment, the bi-fold doors folded on the wall in the shower room, as well as, 11*d*, which shows the bi-fold doors in the drying room on the wall at the exist door. Both doors are now: on the wall, units are open and are enlarged, the user is no longer there, and neither is the gown (Other features remains same).

In an embodiment, the doors remain on the wall, but the water-proof chair is removed from the drying room. Removing the water-proof chair, as further enlarges the area of the units and reveals the Shower/Hair and Body Care Drying System is built within one installation.

Figure 7:
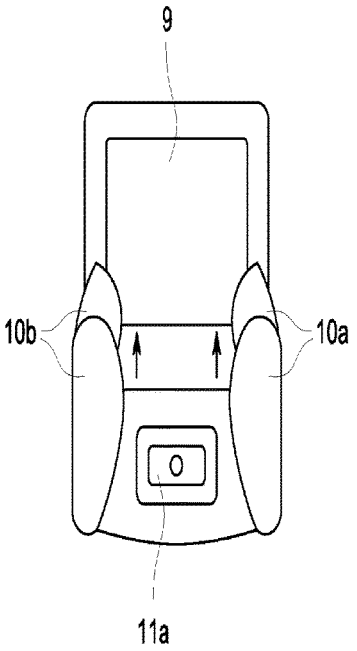
FIG. 7 is a front elevational view of the system, according to an embodiment described herein.
Figure 8:
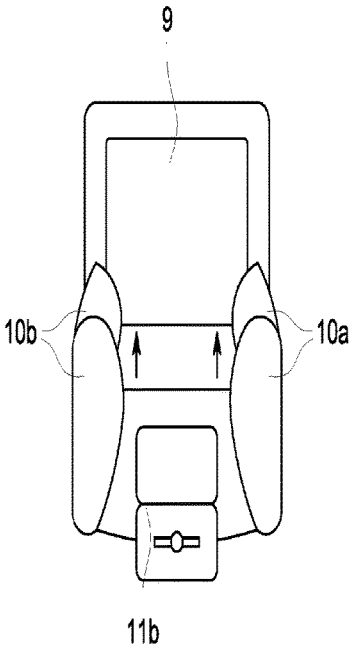
FIG. 8 is a front elevational view of the system, according to an embodiment described herein.

In an embodiment, the back of the water proof chair the arm rest, which is same for the for FIG. 7 and FIG. 8 In another embodiment, the water-proof chair with extended foot rest that glides in and out (gliding apparatus not shown), and is stored under the seat of the chair, and a cubby-hole made in the front of the foot rest for storage of toiletries.

In an embodiment, that cubby-hole is closed and the knob for opening and closing the cubby-hole. In another embodiment, the exposed cover for the cubby-hole with a lock on it.

I claim:

1. A shower system consisting of:

a) a shower head directing a flow of water;

b) a plurality of lights electrically connected to a switch, wherein the plurality of lights are on as the flow of water is directed through the shower head;

c) a first dryer positioned above the shower head, wherein the dryer swivels relative to its mounted position;

d) a second dryer;

e) a waterproof chair configured to receive an individual having a physical disability; and f) a plurality of switches, wherein at least one of the plurality of switches operates a heated floor.

2. The system of claim 1, wherein the second dryer is handheld.

3. The system of claim 2, wherein the waterproof chair has a locking compartment disposed near a bottom portion of a front of the waterproof chair.

4. The system of claim 3, wherein the system is enclosed within a room, wherein the dryer is mounted to a ceiling of the room, wherein the heated floor is opposite the ceiling, and wherein one or more heating means are disposed within the floor.

* * * * *